US006410500B1

(12) United States Patent
Haerer et al.

(10) Patent No.: US 6,410,500 B1
(45) Date of Patent: Jun. 25, 2002

(54) MOULDED BODY DISHWASHER DETERGENTS WITH SOIL RELEASE POLYMERS

(75) Inventors: Juergen Haerer, Duesseldorf; Thomas Mueller-Kirschbaum, Solingen; Christian Nitsch; Thomas Moeller, both of Duesseldorf; Hans-Josef Beaujean, Dormagen; Bernd Richter, Leichlingen, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/446,451

(22) PCT Filed: Dec. 21, 1998

(86) PCT No.: PCT/EP98/08368

§ 371 (c)(1),
(2), (4) Date: May 8, 2000

(87) PCT Pub. No.: WO99/35234

PCT Pub. Date: Jul. 15, 1999

(30) Foreign Application Priority Data

Dec. 30, 1997 (DE) ..... 197 58 181

(51) Int. Cl.[7] ..... C11D 17/00; C11D 3/37

(52) U.S. Cl. ..... 510/445; 510/224; 510/294; 510/298; 510/299; 510/300; 510/446

(58) Field of Search ..... 510/445, 294, 510/298, 224, 299, 300, 446

(56) References Cited

U.S. PATENT DOCUMENTS

| | | | | |
|---|---|---|---|---|
| 3,185,649 A | * | 5/1965 | Hampson et al. | 252/99 |
| 3,424,842 A | | 1/1969 | Nürnberg | |
| 4,101,456 A | | 7/1978 | Renaud et al. | |
| 5,182,105 A | * | 1/1993 | Takata et al. | 424/78.02 |
| 5,478,501 A | * | 12/1995 | Rau | 252/547 |
| 5,783,540 A | * | 7/1998 | Secemski et al. | 510/224 |
| 5,837,663 A | * | 11/1998 | Nicholson et al. | 510/226 |
| 5,866,531 A | | 2/1999 | Assmann et al. | 510/446 |
| 5,888,954 A | | 3/1999 | Haerer et al. | 510/226 |
| 5,900,395 A | * | 5/1999 | Nicholson et al. | 510/224 |
| 5,900,399 A | * | 5/1999 | Seiter et al. | 510/446 |
| 5,981,456 A | * | 11/1999 | Tartakovsky et al. | 510/220 |

FOREIGN PATENT DOCUMENTS

| | | | |
|---|---|---|---|
| DE | 938 566 | | 2/1956 |
| DE | 12 28 029 | | 11/1966 |
| DE | 26 16 404 | | 10/1976 |
| DE | 41 21 127 | | 1/1993 |
| DE | 41 28 672 | | 3/1993 |
| DE | 43 25 922 | | 2/1995 |
| DE | 43 38 724 | | 5/1995 |
| DE | 44 16 438 | | 11/1995 |
| DE | 44 43 177 | | 6/1996 |
| DE | 195 29 905 | | 2/1997 |
| DE | 195 36 082 | | 4/1997 |
| DE | 196 05 688 | | 8/1997 |
| DE | 196 13 103 | | 10/1997 |
| DE | 196 20 411 | | 10/1997 |
| DE | 196 16 693 | | 11/1997 |
| DE | 196 16 767 | | 11/1997 |
| DE | 196 16 769 | | 11/1997 |
| DE | 196 16 770 | | 11/1997 |
| DE | 196 20 267 | | 11/1997 |
| DE | 197 10 254 | | 9/1998 |
| DE | 197 27 073 | | 1/1999 |
| EP | 0 167 382 | | 1/1986 |
| EP | 0 272 030 | | 6/1988 |
| EP | 0 342 997 | | 11/1989 |
| EP | 0 392 592 | | 10/1990 |
| EP | 0 443 651 | | 8/1991 |
| EP | 0 446 982 | | 9/1991 |
| EP | 0 453 003 | | 10/1991 |
| EP | 0 458 397 | | 11/1991 |
| EP | 0 458 398 | | 11/1991 |
| EP | 0 466 485 | | 1/1992 |
| EP | 0 467 472 | | 1/1992 |
| EP | 0 481 547 | | 4/1992 |
| EP | 0481547 | * | 4/1992 |
| EP | 0 522 766 | | 1/1993 |
| EP | 0 523 099 | | 1/1993 |
| EP | 0 525 239 | | 2/1993 |
| EP | 0 544 490 | | 6/1993 |
| EP | 0 544 519 | | 6/1993 |
| EP | 0 549 271 | | 6/1993 |
| EP | 0 549 272 | | 6/1993 |
| EP | 0 693 550 | | 1/1996 |
| EP | 0 711 827 | | 5/1996 |
| EP | 0 711 828 | | 5/1996 |
| EP | 0 716 144 | | 6/1996 |
| JP | 5-331497 | | 12/1993 |
| JP | 5331497 | * | 12/1993 |
| WO | WO 94/27970 | | 12/1994 |
| WO | WO 94/28102 | | 12/1994 |
| WO | WO 94/28103 | | 12/1994 |
| WO | WO 95/00626 | | 1/1995 |
| WO | WO 95/14075 | | 5/1995 |
| WO | WO 95/14759 | | 6/1995 |
| WO | WO 95/17498 | | 6/1995 |
| WO | 95/20030 | * | 7/1995 |
| WO | WO 95/20030 | | 7/1995 |
| WO | WO 95/27775 | | 10/1995 |
| WO | WO 96/06156 | | 2/1996 |
| WO | 97/03177 | * | 1/1997 |
| WO | WO 97/03177 | | 1/1997 |

OTHER PUBLICATIONS

Römpp Chemie Lexikon 9th ed., vol. 6, p. 4440 (English translation), no date available.
Lehrbuch der pharmazeutischen Technologie, 6 (1987) pp. 182–184 (English translation).
SÖFW–Journal, 119, (1993) pp. 794–808.

* cited by examiner

*Primary Examiner*—Lorna M. Douyon
(74) *Attorney, Agent, or Firm*—Glenn E.J. Murphy

(57) ABSTRACT

Shaped bodies containing builders, alkali sources, bleaching agents, enzymes and surfactants. Particularly high-performance detersive shaped bodies with high stability in storage, a good perfume profile and a defined solubility profile are obtained if more than 80% by weight of the total content of an active substance (1) containing a constituent from the group of soil-release compounds is present in a region which makes up no more than 40% by volume of the shaped body.

21 Claims, No Drawings

MOULDED BODY DISHWASHER DETERGENTS WITH SOIL RELEASE POLYMERS

This invention relates to detersive shaped bodies, primarily tablets, such as dishwasher tablets, laundry detergent tablets, bleach tablets, stain remover tablets or water softening tablets, for use in the home, more particularly for use in machines, to a process for their production and to their use.

Detersive shaped bodies, more particularly tablets, have a number of advantages over powder-form compositions, such as easy handling, simple dosage and low packaging volumes.

Unfortunately, problems arise out of the fact that, to achieve adequate dimensional stability and fracture resistance, relatively high pressures have to be applied in the compression of the powder-form ingredients. In view of the heavy compaction which they undergo, corresponding tablets often show inadequate storage stability in regard to sensitive ingredients (bleaching agent, perfume, enzymes, silver protectors, dyes, surfactants), reduced performance (particularly against such soils as tea, milk, starch) by comparison with comparable amounts of active ingredient made up in another form, occasionally inadequate protection of sensitive materials to be cleaned and impaired disintegration and dissolving properties in use.

According to some patents belonging to the prior art, some of these problems are said to have been solved.

In many cases, however, the consumer is unable to reproduce the performance advantages described in those documents. Accordingly, an important problem confronting manufacturers of detersive shaped bodies is to satisfy the consumer.

Accordingly, the problem addressed by the present invention was to provide high-performance, easy-to-handle detersive shaped bodies, above all dishwasher tablets, laundry detergent tablets, stain remover tablets or water softener tablets for use in the home, more particularly for use in machines, with high storage stability, minimal packaging volume, a good fragrance profile and a defined solubility profile which, above all, would guarantee high consumer satisfaction.

This problem has surprisingly been solved by a shaped body in which an ingredient (I) is mainly located in a defined region, this region representing no more than 40% by volume of the shaped body.

Accordingly, the present invention relates to a shaped body containing builders, alkali sources, bleaching agents, enzymes and surfactants, characterized in that more than 80% by weight of an active substance (I) containing a constituent from the group of soil-release compounds is present in a region of no greater than 40% by volume.

Besides the constituent from the group of soil-release compounds, the ingredient (I) may also be an oxygen- or chlorine-based bleaching agent, a bleach activator, a silver protector and/or a soil-release compound, an enzyme, a surfactant or a component or a compound for controlling solubility. However, the ingredient (I) may also be a mixture of these components.

In one particularly preferred embodiment, the ingredient (I) is a mixture of a component or a compound for controlling solubility besides the constituent from the group of soil-release compounds and at least one other ingredient from the group consisting of bleaching agent and/or bleach activator and/or silver protector and/or soil-release compound and/or enzyme and/or a surfactant.

The solubility of the region containing the ingredient (I), the surface, the nature of the compression and storage stability can also have a critical bearing on the properties of the tablet.

According to the invention, it is favorable if the region containing more than 80% by weight, preferably more than 90% by weight, more preferably more than 95% by weight and, most preferably, 100% by weight of an ingredient (I) present is surrounded in exactly three directions in space by other ingredients of the shaped body.

In another preferred embodiment of the invention, at least one region containing more than 80% by weight, preferably more than 90% by weight, more preferably more than 95% by weight and most preferably 100% by weight of an ingredient (I) present dissolves more than 5%, preferably more than 10%, more preferably more than 25%, most preferably more than 50% and, in one particularly advantageous embodiment, more than 100% faster than the remaining region and/or regions of the shaped body.

According to the invention, it is also positive if more than 80% by weight, preferably more than 90% by weight, more preferably more than 95% by weight and most preferably 100% by weight of an ingredient (I) present is contained in a region of no greater than 40% by volume, preferably between 5 and 30% by volume, more preferably between 10 and 25% by volume and most preferably between 15 and 20% by volume of the shaped body.

The overall result can also be desirably influenced if the increase in weight of the region with no more than 40% of the surface containing more than 80% by weight of an ingredient (I) during storage under normal domestic conditions, i.e. between 15 and 30° C. and between 5 and 55% and preferably between 15 and 35% air humidity for a period of 30 days, preferably 60 days and more preferably 90 days is no more than 50% by weight, preferably no more than 40% by weight, more preferably no more than 30% by weight, most preferably no more than 20% by weight and, in one particularly advantageous embodiment, no more than 10% by weight and, in the most favorable case, no more than 5% by weight.

The overall result can also be desirably influenced if the loss of active substance (I) of the region during storage under normal domestic conditions, i.e. between 15 and 30° C. and between 5 and 55% and preferably between 15 and 35% air humidity for a period of 30 days, preferably 60 days and more preferably 90 days is no more than 50% by weight, preferably no more than 40% by weight, more preferably no more than 30% by weight, most preferably no more than 20% by weight and, in one particularly advantageous embodiment, no more than 10% by weight and, in the most favorable case, no more than 5% by weight.

The overall result can also be desirably influenced if the absorption maximum of a 1% solution of a colored region or a colored component during storage under normal domestic conditions, i.e. between 15 and 30° C. and between 5 and 55% and preferably between 15 and 35% air humidity for a period of 30 days, preferably 60 days and more preferably 90 days is no more than 100 wave numbers, preferably no more than 50 wave numbers, more preferably no more than 30 wave numbers, most preferably no more than 20 wave numbers and, in one particularly advantageous embodiment, no more than 10 wave numbers and, in the most favorable case, no more than 5 wave numbers.

The shaped body according to the invention is also positively influenced if the region containing more than 80% by weight, preferably more than 90% by weight, more preferably more than 95% by weight and, most preferably, 100% by weight of an ingredient (I) present is surrounded in exactly three directions in space by other ingredients of the shaped body.

Solubility

The solubility can be influenced by components and/or compounds for accelerating solubility (disintegrators) or retarding solubility.

Suitable disintegrators are any of the disintegrators known from the prior art. Particular reference is made in this regard to *Römpp* (*9th Edition, Vol. 6, page* 4440) and *Voigt "Lehrbuch der pharmazeutischen Technologie"* (*6th Edition*, 1987). Particularly suitable disintegrators are such materials as starch, cellulose and cellulose derivatives, alginates, dextrans, crosslinked polyvinyl pyrrolidones and others; systems of weak acids and carbonate-containing disintegrators, more particularly citric acid and tartaric acid in combination with hydrogen carbonate or carbonate and polyethylene glycol sorbitan fatty acid ester.

The use of disintegrators is also known from the patent literature. Thus, according to German patent application DE 938 566, acetyl salicylic acid is converted into granular form before compression, carefully but completely dried and then coated with highly disperse silica. The acetyl salicylic acid granules powdered with highly disperse silica may then be mixed with other tablet ingredients present in powder form or granular form and compressed to tablets. The barrier layer of highly disperse silica not only acts as an insulating layer and affords protection against unwanted reactions, it also contributes towards the rapid disintegration of the tablets, even after prolonged storage.

German patent application DE 12 28 029 describes the production of tablets in which powder mixtures are mixed with cellulose powder and optionally highly disperse silica without preliminary granulation and the resulting mixture is compressed, preferably after grinding.

According to German patent application DE 41 21 127, a particularly effective auxiliary in the production of pharmaceutical tablets comprises cellulose particles with a coating material fixed to their surface. The auxiliary is used in fine-particle form, mean particle sizes below 200 $\mu$m being said to be particularly advantageous. Normally, therefore, traditional tablet disintegrators belonging to the first class of substances mentioned are either mixed in very fine-particle form with the other tablet ingredients, which may be present as fine-particles or granules, before the compression step or the other tablet ingredients are coated or powdered with the tablet disintegrator.

According to the teaching of European patent EP-B-0 523 099, disintegrators known from the production of pharmaceuticals may also be used in detergents or cleaning compositions. The disintegrators mentioned include swellable layered silicates, such as bentonites, starch- and cellulose-based natural materials and derivatives thereof, alginates and the like, potato starch, methyl cellulose and/or hydroxypropyl cellulose. These disintegrators may be mixed with the granules to be compressed or may even be incorporated therein.

According to International patent application WO-A-96/06156 also, it can be of advantage to incorporate disintegrators in detergent tablets. In this case, too, typical disintegrators are said to include microcrystalline cellulose, sugars, such as sorbitol, and layered silicates, more particularly fine-particle and swellable layered silicates of the bentonite and smectite type. Effervescent substances, such as citric acid, bisulfate, bicarbonate, carbonate and percarbonate, are also mentioned as possible disintegration aids.

European patent applications EP-A-0 466 485, EP-A-0 522 766, EP-A-0 711 827, EP-A-0 711 828 and EP-A-0 716 144 describe the production of detersive tablets in which compacted particulate material with a particle size of 180 to 2000 $\mu$m is used. The resulting tablets may have both a homogeneous structure and a heterogeneous structure. According to EP-A-0 522 766, at least those particles which contain surfactants and builders are coated with a solution or dispersion of a binder/disintegration aid, more particularly polyethylene glycol. Other binders/disintegration aids are—again—the already repeatedly described and known disintegrators, for example starches and starch derivatives, commercially available cellulose derivatives, such as crosslinked and modified cellulose, microcrystalline cellulose fibers, crosslinked polyvinyl pyrrolidones, layered silicates, etc. Weak acids, such as citric acid or tartaric acid which, in conjunction with carbonate-containing sources, lead to effervescent effects on contact with water and which, according to Römpp's definition, belong to the second class of disintegrators, may also be used as a coating material.

Particular reference is made to hitherto unpublished DE 197 10 254 which describes disintegrators of which the particle size distribution (sieve analysis) is such that at most 1% by weight, preferably less, of dust is present and a total (including any dust present) of less than 10% by weight of the disintegrator granules are smaller than 0.2 mm. At least 90% by weight of the disintegrator granules advantageously have a particle size of at least 0.2 mm and at most 3 mm. These disintegrators are particularly suitable for the purposes of the present invention.

Disintegrators belonging to the group of organic acids, for example citric acid, or a citric acid/bicarbonate mixture and/or the celluloses and cellulose derivatives are also suitable. If a disintegrator is present in the shaped body, the dissolving time of the shaped body as a whole is preferably shorter than the duration of the main wash cycle of a conventional dishwashing machine, i.e. shorter than 40 mins., preferably shorter than 30 mins., more preferably shorter than 20 mins., and most preferably shorter than 10 mins.

In general, paraffins and/or microwaxes and/or the high molecular weight polyethylene glycols described in detail in the prior art are normally used as dissolution retarders. The use of mixtures mentioned in hitherto unpublished DE 197 27 073, of which the disclosure is hereby specifically included as part of the present disclosure, is particularly suitable for the purposes of the present application.

If the shaped body contains a component for retarding solubility, the dissolving time of the shaped body as a whole in cold (20° C.) water—in one preferred embodiment—is longer than the prerinse cycle of a commercially available dishwashing machine, i.e. longer than 5 mins. and preferably longer than 10 mins.

General Forms of Presentation

The shaped body may assume any of the various three-dimensional forms which are listed inter alia in patents belonging to the prior art and in the standard works of the specialist literature (for example: Riedel, "Die Tablette"). The region in which the ingredient (I) is contained is also not confined to any particular three-dimensional form. However, a dimension in one direction in space of more than 5 mm is preferred for practical reasons.

Specific Forms of Presentation

In one preferred embodiment, the invention provides homogeneous or heterogeneous shaped bodies of known construction.

These include in particular cylindrical tablets which preferably have a diameter of 15 to 60 mm and, more particularly, 30±10 mm. The height of these tablets is preferably from 5 to 30 mm and more preferably from 15 to 28 mm. Shaped bodies with a diameter of 32, 33, 34, 35, 36, 37, 38 and 39 mm have proved to be particularly favorable. In particular embodiments, the height is 24, 25, 26, 27 or 28 mm.

However, square, rectangular, trapezoidal, oval and irregularly shaped bases may also be used with advantage. The edge lengths are preferably between 15 and 60 mm and more preferably 30±10 mm.

The weight of the individual shaped bodies, more particularly tablets, is preferably 15 to 60 g and more preferably 20 to 40 g per shaped body or tablet. By contrast, the density of the shaped bodies or tablets normally assumes values above 1 $kg/dm^3$ and preferably in the range from 1.1 to 1.4 $kg/dm^3$.

One or more shaped bodies, for example 2 to 4 shaped bodies, more particularly tablets, may be used according to the particular application, the water hardness range and the nature of the soils to be removed. Other shaped bodies according to the invention may have even smaller diameters or dimensions, for example around 10 mm.

A homogeneous shaped body in the context of the present invention is understood to be one in which the ingredients of the shaped body—except for the region containing ingredient (I)—are homogeneously distributed in such a way that differences between ingredients and/or active substances are not visible to the naked eye. The granular structure of the solids used is of course still discernible. In one preferred embodiment of the invention, only one other region (phase) is present besides the region containing the ingredient (I).

Accordingly, heterogeneous shaped bodies in the context of the present invention are those in which the ingredients present besides the ingredient (I) do not have to be homogeneously distributed. In one simple case, heterogeneous shaped bodies may be produced, for example, by giving the various ingredients different colors and/or by providing them with different fragrance components.

Another case which, according to the invention, counts as a non-homogeneous (heterogeneous) shaped body is an embodiment in which a shaped body comprising several layers (phases), i.e. at least two layers, besides the region containing the ingredient (I) is compressed. For example, these various layers may have different disintegration and dissolving rates and/or may contain different ingredients. This can result in advantageous performance properties of the shaped bodies. If, for example, ingredients which adversely affect one another are present in the shaped bodies, they can be separated. If a particular sequence of cleaning conditions is to be created in a machine, one (or more) component(s) may be integrated in a (or the) faster disintegrating and/or faster dissolving layer while the other component(s) is incorporated in a (or the) more slowly dissolving layer, so that one component can act in advance or can have already reacted off by the time another component dissolves.

In one preferred embodiment of the invention, another two phases are present besides the region containing the ingredient (I). It is particularly favorable if the ratios by volume of the other two phases are between 10:1 and 1:10, preferably between 5:1 and 1:5 and more preferably between 2:1 and 1:2.

Another particularly preferred embodiment is characterized in that three or more other phases are present.

The layered structure of the shaped bodies may be stack-like, in which case the inner layer(s) dissolve(s) at the edges of the shaped body before the outer layers have completely dissolved or disintegrated. However, the inner layer(s) may also be completely and/or partly surrounded by the layers situated further to the outside which prevents and/or retards the early dissolution of constituents of the inner layer(s).

In another preferred embodiment of the invention, a tablet consists of at least three layers, i.e. two outer layers and at least one inner layer, at least one of the inner layer(s) containing a peroxy bleaching agent whereas, in the case of the stack-like tablet, the two cover layers and—in the case of the jacket-like tablet—the outermost layers are free from peroxy bleaching agent. Peroxy bleaching agent and any bleach activators or bleach catalysts and/or enzymes present can also be separated from one another in one and the same tablet and/or shaped body. Embodiments such as these have the advantage that there is no danger of any unwanted interactions in the shaped bodies according to the invention.

In another favorable and preferred embodiment of the present invention, one of the bleach components or the bleach component, more especially the chlorine component, is not made up in one phase with the perfume component. Another favorable and preferred embodiment of the invention is characterized in that the silver protector component is not made up with (any of) the bleach component(s). In another favorable and preferred embodiment of the invention, one of the components, or the component, for controlling solubility is made up together with the bleach activator. Another favorable and preferred embodiment of the invention is characterized in that one of the components, or the component, for controlling solubility is made up together with enzymes. Another favorable and preferred embodiment of the invention is characterized in that one of the components, or the component, for controlling solubility is made up together with the bleaching agent. Another favorable and preferred embodiment of the invention is characterized in that one of the components, or the component, for controlling solubility is made up together with the silver protector component. Another favorable and preferred embodiment of the invention is characterized in that one of the components, or the component, for controlling solubility is made up together with at least 50% by weight, preferably more than 70% by weight and, more preferably, more than 90% by weight of a surfactant or the surfactant mixture as a whole.

The shaped bodies according to the invention are produced by any of the methods normally used for producing shaped bodies.

In some embodiments, it has proved to be particularly favorable to introduce the region containing the ingredient (s) (I) in the form of a liquid (quite generally a solution and/or melt), optionally at elevated temperature, into a preformed recess of the surrounding ingredients and then to allow this region to solidify by applying conventional technical measures (quite generally drying and/or cooling). A viscosity of more than 1,500 mPas, preferably more than 2,000 mPas, more preferably between 2,000 and 15,000 mPas, most preferably between 2,500 and 7,000 mPas and, in a particularly advantageous embodiment, between 3,000 and 4,000 mPas, has proved to be particularly effective.

It has proved to be particularly effective to combine the ingredient (I) with fusible carrier materials. These include in principle any substances which solidify at or particularly above room temperature.

According to the invention, nonionic surfactants (Dehypon® LT 104, Dehypon® LS 54, Dehydol® LS 30, Lutensol® AT 80), polyethylene glycols with various molecular weights (PEG 400, 12000), soaps (Lorol® C 16), stearates (Cutina® GMS), and also thickened caustic soda and fusible salts, such as sodium carbonate decahydrate, have proved to be particularly suitable carrier materials. The advantages and disadvantages of the individual ingredients can be reproduced by the expert in tests.

According to the invention, particularly suitable fusible components are waxes. "Waxes" in the context of the invention are understood to be a number of natural or synthetic substances which generally melt above 40° C. without decomposition and which have relatively low viscosities and are non-stringy even at temperatures just above their melting point. Their consistency and solubility are highly temperature-dependent. The waxes are divided into three groups according to their origin, namely: the natural waxes, chemically modified waxes and the synthetic waxes.

The natural waxes include, for example, candelilla wax, carnauba wax, Japan wax, espartograss wax, cork wax, guaruma wax, rice oil wax, sugar cane wax, ouricury wax or montan wax; animal waxes, such as beeswax, shellac wax, spermaceti, lanolin (wool wax), uropygial fat; mineral waxes, such as ceresine, ozocerite (earth wax); and petrochemical axes, such as petrolatum, paraffin waxes or microwaxes.

The chemically modified waxes include, for example, hard waxes, such as montan ester waxes, sassol waxes and hydrogenated jojoba waxes.

Synthetic waxes are generally understood to be polyalkylene waxes and polyalkylene glycol waxes.

Waxes in the context of the present invention also include, for example, the so-called wax alcohols. Wax alcohols are relatively high molecular weight, water-insoluble fatty alcohols containing more than 28 to 40 carbon atoms. The wax alcohols occur, for example, in the form of wax esters of relatively high molecular weight fatty acids (wax acids) as the main constituent of many natural waxes. Examples of wax alcohols are lignoceryl alcohol (1-tetracosanol) and melissyl alcohol. The fusible component may also contain wool wax alcohols which are understood to be triterpene and steroid alcohols, for example lanolin. According to the invention, fatty acid glycerol esters and fatty acid alkanolamides and, optionally, water-insoluble or substantially water-insoluble polyalkylene glycol compounds may also be used at least partly as a constituent of the fusible component.

The fusible component preferably contains paraffin wax for the most part. In other words, at least 50% by weight of the fusible component, preferably more, consists of paraffin wax. Paraffin wax contents in the jacket of around 60% by weight, 70% by weight or 80% by weight are particularly suitable, higher paraffin wax contents, for example of more than 90% by weight, being particularly preferred. In one particular embodiment, the fusible component consists entirely of paraffin wax.

In the context of the present invention, paraffin waxes have the advantage over the other natural waxes mentioned that they do not undergo hydrolysis in an alkaline detergent environment (in contrast to the wax esters for example) because paraffin wax does not contain any hydrolyzable groups.

Paraffin waxes consist mainly of alkanes and small amounts of iso- and cycloalkanes. The paraffin wax to be used in accordance with the invention preferably contains hardly any constituents with a melting point above 70° C. and more preferably above 60° C. If the temperature in the wash liquor falls these values, high-melting alkanes in the paraffin can leave unwanted wax residues behind on the surfaces or the ware to be cleaned. Wax residues generally leave the cleaned surface with an unpleasant appearance and should therefore be avoided. The jacket according to the invention preferably contains at least one paraffin wax with a melting point of about 57° C. to about 60° C.

The paraffin wax used preferably has a high content of alkanes, isoalkanes and cycloalkanes solid at ambient temperature (generally about 10 to about 30° C.). The greater the percentage of solid wax constituents present in a wax at room temperature, the more suitable that wax is for use in accordance with the invention. The resistance of the jacket to impact or friction on other surfaces increases with increasing percentage of solid wax constituents which leads to longer-lasting protection of the jacketed particles. High levels of oils or liquid wax constituents can lead to weakening of the jacket so that pores are opened and the particles made up with the fusible component are exposed to the environmental influences mentioned at the beginning.

At unusually low temperatures, for example at temperatures below 0° C., the solidified fusible component can disintegrate on impact or friction. In order to improve stability at such low temperatures, additives may be incorporated in the fusible component. Suitable additives must be completely miscible with the molten wax, should not significantly change the melting range of the jacket, should improve the elasticity of the solidified fusible component at low temperatures, should generally not increase the permeability of the solidified fusible component to water or moisture and should not increase the viscosity of the melt of the jacket material to such an extent that processing is made difficult to or even impossible. Suitable additives, which reduce the brittleness of a jacket consisting essentially of paraffin at low temperatures, are for example EVA copolymers, hydrogenated resin acid methyl esters, polyethylene or copolymers of ethyl acrylate and 2-ethyl hexyl acrylate.

Besides paraffin, the fusible component may contain one or more of the above-mentioned waxes or wax-like substances as a principal constituent. Basically, the properties of the jacket-forming mixture should be such that the jacket is at least substantially insoluble in water. The solubility in water should not exceed about 10 mg/l at a temperature of about 30° C. and is preferably below 5 mg/l.

The use of mixtures mentioned in hitherto unpublished DE 197 27 073, of which the disclosure is hereby specifically included as part of the present disclosure, is particularly suitable for the purposes of the present application.

In other embodiments, parts of the shaped body and/or components of the shaped body are treated by exposure to microwave radiation in order positively to influence their strength, moisture content and solubility.

However, the constituents may also be simply compressed. In this case, microtabs and shaped bodies smaller in their dimensions than the final shaped body may be used in addition to powders and granules.

Specific Ingredients

Particular ingredients (I) used in accordance with the invention are substances which prevent the resoiling of surfaces and/or which facilitate the separation of soil after a single application (so-called soil-release compounds).

The soil-release compounds used in accordance with the invention include any of the compounds known from the prior art. Cationic polymers known, for example, from the following documents are particularly suitable:

According to EP-A-0 167 382, EP-A-0 342 997 and DE-OS 26 16 404, cationic polymers are added to cleaning compositions to obtain streak-free cleaning of the surfaces.

EP-A-0 167 382 describes liquid cleaning compositions which may contain cationic polymers as thickeners. Hydroxypropyl trimethyl ammonium guar; copolymers of aminoethyl methacrylate and acrylamide and copolymers of dimethyl diallyl ammonium chloride and acrylamide are described as particularly suitable cationic polymers.

EP-A-0 342 997 describes multipurpose cleaners which may contain cationic polymers, polymers containing imino groups in particular being used.

DE-OS 26 16 404 describes cleaning compositions for glass containing cationic cellulose derivatives. The addition of the cationic cellulose derivatives to the compositions ensures better drainage of the water so that streak-free glass is obtained.

EP-A-0 467 472, for example, describes cleaning compositions for hard surfaces which contain cationic homopolymers and/or copolymers as soil-release polymers. These polymers contain quaternized ammonium alkyl methacrylate groups as monomer units. These compounds are used to finish the surfaces in such a way that the soils can be removed more easily the next time the surfaces are cleaned.

Particular preference is attributed to the cationic polymers selected from cationic polymers of copolymers of such monomers as trialkyl ammonium alkyl (meth)acrylate or acrylamide; dialkyl diallyl diammonium salts; polymer-analog reaction products of ethers or esters of polysaccharides with lateral ammonium groups, more particularly guar, cellulose and starch derivatives; polyadducts of ethylene oxide with ammonium groups; quaternary ethylene imine polymers and polyesters and polyamides containing quaternary lateral groups as soil-release compounds.

Natural polyuronic acids and related substances and also polyampholytes and hydrophobicized polyampholytes and mixtures of these substances are also particularly preferred for the purposes of the present invention.

According to the invention, between 0 and 5% by weight of enzymes, based on the composition as a whole, may be added to the detergent/cleaner to improve performance or guarantee the same quality of cleaning under milder conditions. The most commonly used enzymes include lipases, amylases, cellulases and proteases. Preferred proteases are, for example, BLAP® 140 (Biozym), Optimase® M-440 and Opticlean® M-250 (Solvay Enzymes); Maxacal® CX and Maxapem® or Esperase® (Gist Brocades) and even Savinase® (Novo). Particularly suitable celluloses and lipases are Celluzym® 0,7 T and Lipolase® 30 T (Novo Nordisk). Particularly suitable amylases are Duramyl® and Termamyl® 60 T and Termamyl® 90 T (Novo), Amylase-LT® (Solvay Enzymes) and Maxamyl® P5000 (Gist Brocades). Other enzymes may also be used.

Particular ingredients (I) used in accordance with the invention are oxygen bleaching agents, preferably the alkali metal perborates and hydrates thereof and alkali metal percarbonates, sodium perborate (monohydrate or tetrahydrate) or sodium percarbonate and hydrates thereof preferably being used in accordance with the invention. The persulfates may also be used.

However, other typical oxygen bleaching agents are the organic peracids. Organic acids preferably used include above all the extremely effective phthalimidoperoxycaproic acid although, in principle, any other known peracids may also be used.

Particular ingredients (I) used in accordance with the invention are bleach activators. Known bleach activators are compounds which contain one or more N- or O-acyl groups, such as compounds from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexahydro-1,3,5-triazine (DADHT) and isatoic anhydride (ISA).

The bleach activators used may be compounds which form aliphatic peroxocarboxylic acids preferably containing 1 to 10 carbon atoms and, more particularly, 2 to 4 carbon atoms and/or optionally substituted perbenzoic acid under perhydrolysis conditions. Suitable bleach activators are substances which carry O-and/or N-acyl groups with the number of carbon atoms mentioned and/or optionally substituted benzoyl groups. Preferred bleach activators are polyacylated alkylenediamines, more especially tetraacetyl ethylenediamine (TAED), acylated triazine derivatives, more especially 1,5-diacetyl-2,4-dioxohexahydro-1,3,5-triazine (DADHT), acylated glycolurils, more especially tetraacetyl glycoluril (TAGU), N-acyl imides, more especially N-nonanoyl succinimide (NOSI), acylated phenol sulfonates, more particularly n-nonanoyl or isononanoyloxybenzene-sulfonate (n- or iso-NOBS), carboxylic anhydrides, more especially phthalic anhydride, acylated polyhydric alcohols, more especially triacetin, ethylene glycol diacetate, 2,5-diacetoxy-2,5-dihydrofuran, n-methyl morpholinium acetonitrile methyl sulfate (MMA) and the enol esters known from German patent applications DE 196 16 693 and DE 196 16 767 and also acetylated sorbitol and mannitol and the mixtures thereof (SORMAN) described in European patent application EP 0 525 239, acylated sugar derivatives, more especially pentaacetyl glucose (PAG), pentaacetyl fructose, tetraacetyl xylose and octaacetyl lactose and acetylated, optionally N-alkylated, glucamine and gluconolactone, and/or the N-acylated lactams, for example N-benzoyl caprolactam, which are known from International patent applications WO 94/27970, WO 94/28102, WO 94128103, WO 95100626, WO 95/14759 and WO 95/17498. The hydrophilically substituted acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Bleach activators such as these are present in the usual quantities, preferably in quantities of 1% by weight to 10% by weight and more preferably in quantities of 2% by weight to 8% by weight, based on the detergent/cleaner as a whole.

In addition to or instead of the conventional bleach activators mentioned above, the sulfonimines known from European patents EP 0 446 982 and EP 0 453 003 and/or bleach-boosting transition metal salts or transition metal complexes may be present as so-called bleach catalysts. Suitable transition metal compounds include in particular the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 or in European patent applications EP 0 458 397, EP 0 458 398, EP 0 549 271, EP 0 549 272, EP 0 544 490 and EP 0 544 519. Combinations of bleach activators and transition metal bleach catalysts are known, for example, from German patent application DE 196 13 103 and International patent application WO 95/27775. Bleach activators from the group of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl or isononanoyloxybenzenesulfonate (n- or iso-NOBS), MMA are preferably used, preferably in quantities of up to 10% by weight, more preferably in quantities of 0.1% by weight to 8% by weight, most preferably in quantities of 2 to 8% by weight and, with particular advantage, in quantities of 2 to 6% by weight, based on the detergent/cleaner as a whole.

Bleach-boosting transition metal complexes, more particularly containing the central atoms Mn, Fe, Co, Cu, Mo, V, Ti and/or Ru, preferably selected from the group of manganese and/or cobalt salts and/or complexes, more preferably the cobalt (ammine) complexes, cobalt (acetate) complexes, cobalt (carbonyl) complexes, chlorides of cobalt or manganese and manganese sulfate, are also present in typical quantities, preferably in a quantity of up to 5% by weight, more preferably in a quantity of 0.0025% by weight to 1% by weight and most preferably in a quantity of 0.01% by weight to 0.25% by weight, based on the detergent/cleaner as a whole. In special cases, however, more bleach activator may even be used.

Dishwasher detergents according to the invention may contain corrosion inhibitors as ingredient (I) to protect the tableware or the machine itself, silver protectors being particularly important for dishwashing machines. Known corrosion inhibitors, for example those described in DE 43 25 922, DE 41 28 672 and DE 43 38 724, may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. According to the above documents, chlorine-free dishwashing detergents contain in particular oxygen- and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt(ammine) complexes, cobalt(acetate) complexes, cobalt(carbonyl) complexes, chlorides of cobalt or manganese and manganese sulfate being particularly preferred. Zinc compounds may also be used to prevent corrosion of tableware.

Other Ingredients

In the shaped bodies according to the invention, all ingredients (I) described above can also perform the function of other ingredients should the condition of the region according to the invention be fulfilled by other ingredients.

Water-soluble and water-insoluble builders may be used in the detergents/cleaners according to the invention, above all to bind calcium and magnesium. Water-soluble builders are preferred because, in general, they tend less to form insoluble residues on tableware and hard surfaces. Typical builders which may be present in quantities of 10 to 90% by weight, based on the composition as a whole, in accordance with the invention are the low molecular weight polycarboxylic acids and salts thereof, the homopolymeric and copolymeric polycarboxylic acids and salts thereof, the carbonates, phosphates and silicates. Water-insoluble builders include the zeolites, which may also be used, and mixtures of the builders mentioned above.

Trisodium citrate and/or pentasodium tripolyphosphate and/or sodium carbonate and/or sodium bicarbonate and/or gluconates and/or silicate builders from the class of disilicates and/or metasilicates are preferably used.

Alkali sources may be present as further ingredients. Alkali sources are alkali metal hydroxides, alkali metal carbonates, alkali metal hydrogen carbonates, alkali metal sesquicarbonates, alkali metal silicates, alkali metal metasilicates and mixtures of the substances mentioned above. According to the invention, alkali metal carbonates, more particularly sodium carbonate, sodium hydrogen carbonate or sodium sesquicarbonate, are preferably used.

A builder system containing a mixture of tripolyphosphate and sodium carbonate is particularly preferred.

Another particularly preferred builder system contains a mixture of tripolyphosphate and sodium carbonate and sodium disilicate.

In principle, any surfactants may be used as surfactants. Nonionic surfactants, above all low-foaming nonionic surfactants, are preferred although other low-foaming surfactants may also be used. Alkoxylated alcohols, especially ethoxylated and/or propoxylated alcohols, alkyl polyglycosides, and alkyl polyglucamides are particularly preferred.

Alkoxylated alcohols are generally understood by the expert to be the reaction products of alkylene oxide, preferably ethylene oxide, with alcohols, the relatively long-chain alcohols ($C_{10}$ to $C_{18}$, preferably between $C_{12}$ and $C_{16}$ such as, for example, $C_{11}$, $C_{12}$, $C_{13}$, $C_{14}$, $C_{15}$, $C_{16}$, $C_{17}$ and $C_{18}$ alcohols) being preferred for the purposes of the present invention. In general, a complex mixture of addition products differing in their degree of ethoxylation is formed from n moles of ethylene oxide and 1 mole of alcohol, depending on the reaction conditions. Another embodiment is characterized by the use of mixtures of alkylene oxides, preferably a mixture of ethylene oxide and propylene oxide. If desired, "end-capped" alcohol ethoxylates, which may also be used in accordance with the invention, may also be obtained by etherification with short-chain alkyl groups, preferably butyl groups, in a concluding step. According to the invention, highly ethoxylated fatty alcohols or mixtures thereof with end-capped fatty alcohol ethoxylates are particularly preferred for the purposes of the invention.

Alkyl polyglycosides are surfactants which may be obtained by reacting sugars and alcohols using the relevant methods of preparative organic chemistry, a mixture of monoalkylated oligomeric or polymeric sugars being obtained according to the particular method of production used. Preferred alkyl polyglycosides are alkyl polyglucosides. In a particularly preferred embodiment, the alcohol is a long-chain fatty alcohol or a mixture of long-chain fatty alcohols while the degree of oligomerization of the sugars is between 1 and 10.

Fatty acid polyhydroxylamides (glucamides) are acylated reaction products of the reductive amination of a sugar (glucose) with ammonia, long-chain fatty acids, long-chain fatty acid esters or long-chain fatty acid chlorides generally being used as acylating agents. Secondary amides are formed if methyl amine or ethyl amine is used instead of ammonia for the reduction process, as described for example in SÖFW Journal, 119, (1993), 794–808. Carbon chain lengths of $C_6$ to $C_{12}$ are preferably used in the fatty acid moiety.

The regions of the shaped body may be colored. In one particularly preferred embodiment, one or more regions in the shaped body or all the regions in the shaped body are differently colored. In one special embodiment of the shaped body, the color is red. In another special embodiment of the shaped body, the color is green. In another special embodiment of the shaped body, the color is yellow. In another special embodiment of the shaped body, the color is a mixture of different colors.

The storage stability of the shaped body is particularly important. In one particularly preferred embodiment of the invention, the increase in weight of the region of the ingredient (I) during storage under normal domestic conditions, i.e. between 15 and 30° C. and between 5 and 55% and preferably between 15 and 35% air humidity for a period of 30 days, preferably 60 days and more preferably 90 days is no more than 50% by weight, preferably no more than 40% by weight, more preferably no more than 30% by weight, most preferably no more than 20% by weight and, in one particularly advantageous embodiment, no more than 10% by weight and, in the most favorable case, no more than 5% by weight.

In another particularly preferred embodiment of the invention, the loss of active substance of the ingredient (I) during storage under normal domestic conditions, i.e. between 15 and 30° C. and between 5 and 55% and preferably between 15 and 35% air humidity for a period of 30 days, preferably 60 days and more preferably 90 days is no more than 50% by weight, preferably no more than 40% by weight, more preferably no more than 30% by weight, most preferably no more than 20% by weight and, in one particularly advantageous embodiment, no more than 10% by weight and, in the most favorable case, no more than 5% by weight.

In another particularly preferred embodiment of the invention, the absorption maximum of a 1% solution of a colored region or a colored component during storage under normal domestic conditions, i.e. between 15 and 30° C. and between 5 and 55% and preferably between 15 and 35% air humidity for a period of 30 days, preferably 60 days and more preferably 90 days is no more than 100 wave numbers, preferably no more than 50 wave numbers, more preferably no more than 30 wave numbers, most preferably no more than 20 wave numbers and, in one particularly advantageous embodiment, no more than 10 wave numbers and, in the most favorable case, no more than 5 wave numbers.

EXAMPLES

The following formulations were mixed and compressed to shaped bodies. The ingredients shown in brackets are examples of the class of compounds in question, but may be replaced by other substances listed in the application. The starting formulations represent preferred ranges of the invention.

In the measurement of effectiveness, the particular ingredient (I) selected was transferred to the region according to the invention. In the other region (other regions), it was reduced in accordance with the invention or left out altogether before the studies were carried out. Possible starting formulation (Ra) and test formulations (Va) (figures=% by weight):

| Ingredient | Ra | Va1 | Va2 | Va3 | Va4 | Va5 | Va6 | Va7 |
|---|---|---|---|---|---|---|---|---|
| Phosphate (sodium tripolyphosphate) | 30–60 | 54.8 | 56.4 | 30.5 | 43 | 48 | 48 | 47 |
| Sodium carbonate | 5–25 | 15.9 | 13.2 | 21.5 | 7 | 20 | 12 | 24 |
| Sodium disilicate | 0–40 | 7.3 | 7.5 | 33.7 | 20 | 3 | 14 | |
| Polymer (Sokalan CP5) | 0–10 | 2.2 | 2.2 | | | 1 | | 5 |
| Sodium metasilicate | 0–10 | | | 1.8 | | | | 0 |
| Sodium hydrogen carbonate | 0–10 | | | | 1 | | 3 | |
| Bleach (sodium perborate) | 2–20 | 9.0 | 9.0 | 6.7 | 15 | 10 | 12 | 9 |
| Bleach activator (TAED) (co-pentammine-Cl) | 0–5 | 2.1 | 2.1 | | 3 | 2 | 1 | 1.5 |
| Enzyme (amylase) (Duramyl 60 T) | 0–5 | 2.0 | 2.0 | 0.7 | 3 | 3 | 3 | 2.5 |
| Enzyme (protease) (Blap 200 S) | 0–5 | 1.8 | 1.8 | 1.0 | 2 | 2 | 3 | 2.5 |
| Phosphonate or phosphonic acid | 0–5 | 0.9 | 0.9 | | 2 | | | 1.5 |
| Nonionic surfactant (Dehypon LS 54) | 0–5 | 2.0 | 2.0 | 2.0 | 2 | 4 | 3 | 1.5 |
| Silver protector (benzotriazole) | 0–3 | 0.3 | 0.3 | 0 | 0.3 | 0.2 | | 0.5 |
| Tabletting aid (polyethylene glycol) | 0–10 | | | | | 6 | | |
| Paraffin (Mp.: 53° C.) | 0–10 | | 2.0 | 1.0 | | | | 3 |

-continued

| Ingredient | Ra | Va1 | Va2 | Va3 | Va4 | Va5 | Va6 | Va7 |
|---|---|---|---|---|---|---|---|---|
| Perfume | 0–1 | 0.2 | 0.2 | 0.2 | 1 | 0.4 | 1 | 0.5 |
| Dye | 0–4 | 1.4 | 1.3 | 1.4 | 0.7 | 0.4 | | 1.5 |

The builder system of the above starting formulation may also have the following composition (all other ingredients same as for a).

| Ingredient | Rb | Vb1 | Vb2 | Vb3 | Vb4 | Vb5 | Vb6 | Vb7 |
|---|---|---|---|---|---|---|---|---|
| Phosphate (sodium tripolyphosphate) | 30–60 | 59.8 | 56 | 53 | 48 | 48 | 48 | 47 |
| Carbonate (sodium carbonate) | 5-25 | 21.2 | 20.3 | 22.7 | 17 | 20 | 16 | 24 |
| Polymer (Sokalan CP5) | 0–10 | | 2 | 10 | 5 | 4 | | 5 |
| Sodium metasilicate | 0–10 | | | 1.8 | | | | |
| Sodium hydrogen carbonate | 0–10 | | | | 1 | | 3 | |

Examples of another starting formulation (R) according to the present invention and test formulations (V) (% by weight) are shown in the following Table:

| Ingredient | Rc | Vc1 | Vc2 | Vc3 | Vc4 |
|---|---|---|---|---|---|
| Phosphate (sodium tripolyphosphate) | 15–35 | 30 | 21 | 35 | 40 |
| Carbonate (sodium carbonate) | 25–55 | 39 | 50 | 40 | 35 |
| Sodium hydrogen carbonate | 10–20 | 14 | 19 | 15 | 12 |
| Polymer (Sokalan CP5) | 0–10 | 3 | 0 | | |
| Sodium disilicate | 0–10 | | | | |
| Sodium disilicate | 0–10 | 0 | 0 | 0 | 5 |
| Bleach (sodium perborate) | 2–10 | 7 | 8 | 5 | 5 |
| Bleach activator (TAED) | 0–5 | 1 | 0 | 1 | 1 |
| Enzyme (amylase) (Duramyl 60 T) | 0.4–2 | 1 | 0.5 | 0.5 | 0.5 |
| Enzyme (protease) (Blap 200 S) | 0.4–2 | 1 | 0.5 | 0.5 | 0.5 |
| Phosphonate or phosphonic acid | 0–5 | 0 | 0 | 0 | 0 |
| Nonionic surfactant (Dehypon LS 54) | 0–5 | 2 | 1 | 1 | 1 |
| Silver protector (benzotriazole) | 0–3 | 0.5 | 0 | 0.3 | 0 |
| Paraffin (Mp.: 53° C.) | 0–10 | 0 | 0 | | 0 |
| Perfume | 0–1 | 0 | 0 | 0.7 | 0 |
| Dye | 0–4 | 0.5 | 0 | 1 | 0 |

Further examples of a starting formulation (R) according to the present application and test formulations (V) (% by weight) are shown in the following Table:

| Ingredient | Rd | Vd1 | Vd2 | Vd3 | Vd4 |
|---|---|---|---|---|---|
| Trisodium citrate | 20–55 | 44 | 34 | 44 | 44 |
| Sodium hydrogen carbonate | 5–35 | 24 | 9 | 34 | 20 |
| Carbonate (sodium carbonate) | 0–10 | 7 | | | |
| Polymer (Sokalan CP5) | 0–10 | | 6 | | |
| Sodium disilicate | 0–25 | | 20 | | |
| Bleach (sodium perborate) | 0–22 | 9 | 16 | 17 | |
| Bleach activator (TAED) | 0–25 | 3 | 1 | 0 | 20 |
| Enzyme (amylase) (Duramyl 60 T) | 0.4–5 | 2.5 | 3 | 1 | 5 |
| Enzyme (protease) (Blap 200 S) | 0.4–5 | 2 | 3 | 1 | 5 |
| Phosphonate or phosphonic acid | 0–5 | 1.5 | 2.3 | | 2 |
| Nonionic surfactant (Dehypon LS 54) | 0–5 | 2.5 | 1.7 | 2 | 1 |
| Silver protector (benzotriazole) | 0–3 | 0.5 | 0.5 | | |
| Paraffin (Mp.: 53° C.) | 0–10 | 3 | 1.5 | | |

-continued

| Ingredient | Rd | Vd1 | Vd2 | Vd3 | Vd4 |
|---|---|---|---|---|---|
| Perfume | 0–1 | 0.9 | 0.5 | 1 | 1 |
| Dye | 0–4 | 0.1 | 1.5 | | 2 |

Further examples of a starting formulation (R) according to the present application and test formulations (V) (% by weight) are shown in the following Table:

| Ingredient | Re | Ve1 | Ve2 | Ve3 | Ve4 |
|---|---|---|---|---|---|
| Citrate (trisodium citrate) | 20–55 | 32 | 36 | 38 | 24 |
| Phosphate (trisodium polyphosphate) | 20–55 | 26 | 23 | 24 | 24 |
| Carbonate (sodium carbonate) | 1–15 | 11 | 10 | 11 | 15 |
| Polymer (Sokalan CP5) | 0–10 | | 5 | 1.5 | 6 |
| Silicate (sodium disilicate) | 0–25 | 3 | | | 6 |
| Bleach (sodium perborate) | 2–20 | 16 | 3 | 12 | 9 |
| Bleach activator (TAED) | 0–5 | 0.5 | 5 | 2 | 3 |
| Enzyme (amylase) (Duramyl 60 T) | 0–5 | | 5 | 3 | 2 |
| Enzyme (protease) (Blap 200 S) | 0–5 | | 5 | 0.5 | 2 |
| Phosphonate or phosphonic acid | 0–5 | 2 | 2 | | 2 |
| Tabletting aid (polyethylene glycol) | 0–10 | 6 | 4 | 5 | 0.8 |
| Nonionic surfactant (Dehypon LS 54) | 0–5 | 2.5 | | 2.8 | 2 |
| Silver protector (benzotriazole) | 0–3 | | | 0.2 | 0.2 |
| Paraffin (Mp.: 53° C.) | 0–10 | | | | |
| Perfume | 0–1 | 1 | 1 | | 1 |
| Dye | 0–4 | 0 | 1 | | 1 |

Further examples of a starting formulation (R) according to the present application and test formulations (V) (% by weight) are shown in the following Table:

| Ingredient | Rf | Vf1 | Vf2 | Vf3 | Vf4 |
|---|---|---|---|---|---|
| Phosphate (trisodium polyphosphate) | 40–60 | 49 | 49 | 49 | 50 |
| Carbonate (sodium carbonate) | 0–20 | | 17 | 19 | 5 |

-continued

| Ingredient | Rf | Vf1 | Vf2 | Vf3 | Vf4 |
|---|---|---|---|---|---|
| Polymer (Sokalan CP5) | 0–15 | 2 | 4 | 1 | 6 |
| Silicate (sodium disilicate) | 0–30 | 24 | 6 | 5 | 10 |
| Bleach (sodium perborate) | 0–15 | 10 | 8 | 10 | 8 |
| Bleach activator (TAED) | 0–5 | 1.5 | 2 | 3 | 2 |
| Enzyme (amylase) (Duramyl 60 T) | 0–5 | 2 | 2 | 1.5 | 2.5 |
| Enzyme (protease) (Blap 200 S) | 0–5 | 3.9 | 2 | 1.5 | 2.5 |
| Phosphonate or phosphonic acid | 0–8 | 0.8 | 1 | 1 | 2 |
| Tabletting aid (polyethylene glycol) | 0–10 | 0.2 | 4 | 3.7 | 5 |
| Nonionic surfactant (Dehypon LS 54) | 0–8 | 1.5 | 2 | 4 | 3 |
| Silver protector (benzotriazole) | 0–5 | 0.1 | 0.5 | 0.3 | 0.5 |
| Perfume | 0–2 | 1 | 0.5 | 0.5 | 0.5 |
| Dye | 0–4 | 3 | 2 | 0.5 | 1 |

Further examples of a starting formulation (R) according to the present application and test formulations (V) (% by weight) are shown in the following Table:

| Ingredient | Rg | Vg1 | Vg2 | Vg3 | Vg4 |
|---|---|---|---|---|---|
| Phosphate (trisodium polyphosphate) | 30–60 | 55.7 | 59.6 | 46.5 | 47 |
| Sodium disilicate | 5–40 | 22.3 | 17.5 | 39.2 | 24 |
| Polymer (Sokalan CP5) | 0–10 | 2.2 | 2.2 | | 5 |
| Sodium metasilicate | 0–10 | | | 1.8 | |
| Sodium hydrogen carbonate | 0–10 | | | | |
| Bleach (sodium perborate) | 2–20 | 10 | 10 | 6.7 | 10 |
| Bleach activator (co-catalyst) | 0–2 | 1.1 | 1.1 | | 0.5 |
| Enzyme (amylase) (Duramyl 60 T) | 0–5 | 2.0 | 2.0 | 0.7 | 2.5 |
| Enzyme (protease) (Blap 200 S) | 0–5 | 1.8 | 1.8 | 1.0 | 2.5 |
| Phosphonate or phosphonic acid | 0–5 | 0.9 | 0.9 | | 1.5 |
| Nonionic surfactant (Dehypon LS 54) | 0–5 | 2.0 | 2.0 | 2.0 | 1.5 |
| Silver protector (benzotriazole) | 0–3 | 0.3 | 0.3 | 0 | 0.5 |
| Tabletting aid (polyethylene glycol) | 0–10 | | | | |
| Paraffin (Mp.: 53° C.) | 0–10 | 2.0 | 1.0 | 3 | |
| Perfume | 0–1 | 0.2 | 0.2 | 0.2 | 0.5 |
| Dye | 0–4 | 1.4 | 1.3 | 1.4 | 1.5 |

Further examples of a starting formulation (R) according to the present application and test formulations (V) (% by weight) are shown in the following Table:

| Ingredient | Ri1 | Vi1 | Vi2 | Vi3 |
|---|---|---|---|---|
| Sodium carbonate | 35–55 | 43.5 | 45 | 55 |
| Sodium hydrogen carbonate | 15–35 | 15 | 25 | 34 |
| Polymer (Sokalan CP5) | 3–10 | 5 | 3 | 0 |
| Sodium metasilicate | 0–10 | 3 | 2 | 0 |
| Bleach (sodium perborate) | 5–12 | 6 | 10 | 8 |
| Bleach activator (TAED) | 0–5 | 1 | 2 | 0 |
| Enzyme (amylase) (Duramyl 60 T) | 0.4–2 | 1 | 1 | 0.5 |
| Enzyme (protease) (Blap 200 S) | 0.4–2 | 1 | 1 | 0.5 |
| Phosphonate or phosphonic acid | 0–5 | 0 | 2 | 0 |
| Nonionic surfactant (Dehypon LS 54) | 0–5 | 1 | 2 | 1 |
| Tabletting aid (polyethyLene glycol) | 0–5 | | 3 | |
| Silver protector (benzotriazole) | 0–3 | 0.5 | 1 | 0 |
| Paraffin (Mp.: 53° C.) | 0–10 | 0 | 2 | 0 |
| Perfume | 0–1 | 0 | 1 | 0 |
| Dye | 0–4 | 1 | 1 | 1 |

Should a shaped body according to the invention contain several phases, each formulation may also be the constituents of an individual phase, in other words the percentages are then not based—as usual—on the formulation as a whole, but rather on the composition of individual phase.

Each of the formulations may of course also contain other ingredients typical of MDWM (for example fillers, preservatives and the like) in extremely small quantities, in which case the percentage contents of the other ingredients should be varied accordingly.

The production of the shaped bodies according to the invention involves steps which are known to the expert in this field in another connection. A preferred embodiment of the shaped body according to the present invention contains a recess in a tablet, this recess containing the ingredient (I). Production is preferably carried out by forming a depression in a shaped body and filling the depression thus formed. The depression may be formed in a Korsch rotary press. In the present case, a Fette tablet press was used. A round tablet die (26×36 mm) was selected and, using a punch, a 5 mm deep recess was formed in one side, the base of the recess being selected so that a volume of 1 ml could be poured in, the surface of the tablet thereafter becoming smooth again.

A liquid mixture of paraffin and an active substance (I) was then poured in and allowed to cool. The cooling process may be assisted by conventional methods and equipment.

If the soil-release compound is a polymer, the second substance (paraffin) may also be left out by virtue of the particular thermoplastic properties of polymers.

| Ingredient | Rh | Vh1 | Vh2 | Vh3 | Vh4 | Vh5 | Vh6 | Vh7 |
|---|---|---|---|---|---|---|---|---|
| Phosphate (sodium tripolyphosphate) | 30–60 | 40 | 40 | 40 | 45 | 45 | 50 | 35 |
| Sodium metasilicate (5-hydrate) | 5–45 | 45 | 10 | 40 | 10 | 30 | 20 | 35 |
| Sodium metasilicate (0-hydrate) | 5–40 | 10 | 10 | 8 | 10 | 8 | 5 | 10 |
| Sodium disilicate | 0–40 | 0 | 30 | 0 | 15 | 10 | 5 | 0 |
| Paraffin oil | 0–10 | 4 | 5 | 5 | 5 | 6 | 5 | 0 |
| Bleach (trichloroisocyanuric acid) | 0.5–10 | 1 | 2 | 2 | 3 | 1 | 5 | 5 |
| Enzyme (amylase) (Duramyl 60 T) | 0–5 | | | 1 | 2 | | 2 | 2 |
| Enzyme (protease) (Blap 200 S) | 0–5 | | | 1 | 2 | | 2 | 2 |
| Nonionic surfactant (Dehypon LS 54) | 0–5 | | 2 | 2 | 2 | | 2 | 3 |
| Tabletting aid (polyethylene glycol) | 0–10 | | 1 | | 4 | | 2 | 4 |
| Perfume | 0–1 | | 0.3 | 0.3 | 1 | | 1 | 0.5 |
| Dye | 0–4 | | 0.7 | 0.7 | 1 | | 1 | 2.5 |

Another starting formulation (R) (% by weight) and test formulations (V) were tested:

As already mentioned, the ingredient (I) was quantitatively reduced beforehand in accordance with the invention in the corresponding formulation surrounding the filled region and, in the present Examples and studies, was left out in the surrounding regions.

In comparisons with homogeneous tablets (where ingredient (I) does not correspond to the invention) and a few commercially available tablets, the tablets according to the invention proved to be superior.

The particular properties of the detergents/cleaners according to the invention were tested by comparison with known detergents/cleaners using using the removal of enzyme-relevant stains as an example.

In addition, the particular properties of the detergents/cleaners according to the invention were tested by technically untrained people under simulated practical conditions in comparison with homogeneous tablets. Apart from dosing instructions and general safety instructions, the handling of the detergents/cleaners by the people in question in commercially available dishwashing machines was not influenced in any way. This comparison test produced particularly good results. The cleaning results were evaluated as particularly favorable.

The results obtained with a soil-release compound as the ingredient (I) were obtained in a conventional 55° C. wash program. In a mixture corresponding to formulation Ra or Va1, up to 2% by weight of polyuronic acids, cationic polymers and hydrophobicized polyampholytes were used independently of one another, builder being omitted. The cleaning performance against milk and starch-containing soils in a following wash cycle was between 10 and 30% better than in the case of untreated samples.

The effect was discernible even without paraffin. However, the effect was also discernible with paraffins having a melting point of 40 to 44° C. The effect is more pronounced with paraffins having a melting point of 46 to 48° C. The cleaning effect is particularly pronounced with paraffins having a melting point of 57 to 60° C.

The results clearly show that the tablets according to the invention are superior to conventional dishwasher tablets.

In further Examples, melt dispersions of soil-release polymers in shell-forming substances were prepared. Recessed tablets (weight 24 g) were made by compression using a punch with a projection. The composition (in % by weight, based on the premix and hence the recessed tablet) is shown in Table 1 below:

TABLE 1 composition of the premix (% by weight):

| | Premix |
|---|---|
| Sodium carbonate | 24.8 |
| Sodium tripolyphosphate | 62.6 |
| Sodium perborate | 7.5 |
| Tetraacetyl ethylenediamine | 1.1 |
| Benzotriazole | 0.7 |
| $C_{12}$ fatty alcohol · 3 EO | 1.9 |
| Dye | 0.1 |
| Enzymes | 0.7 |
| Perfume | 0.1 |
| Silicone oil | 0.5 |

Melt dispersions SDE 1 to 3 were prepared by heating the particular shell-forming material and stirring in the active substance (soil-release polymer). Their composition (% by weight, based on the melt) is shown in the following Table:

| | SDE 1 | SDE 2 | SDE 3 |
|---|---|---|---|
| Paraffin, Mp.: 57–60° C. | 50 | 50 | 50 |
| Polyuronic acid | 50 | — | — |
| Hydroxypropyl trimethyl ammonium guar | — | 50 | — |
| Polymer JR 400* | — | — | 50 |

*Hydroxyethyl cellulose, quaternized (Amerchol)

The melt dispersions were introduced into the shaped bodies as described above and allow to cool. Before they were filled, the shaped bodies weighed 24 g and were each filled with 1.3 g of the melt dispersion. The cleaning performance of the shaped bodies E1 to E3 filled with melt dispersions SDE1 to SDE3 was tested against various soils. To this end, test soils were prepared from mixtures of milk, egg yolk and oat flakes and the soiled plates were washed in a commercially available dishwashing machine.

The cleaning performance of the tablets against the test soils was visually assessed by experts and scored on a scale of 0 to 10 where "0"=no cleaning and "10"=complete removal of the stains.

The tea stain removal scores were awarded for washing conditions of 55° C./16° d water hardness in the main wash cycle (i.e. "hard conditions"). A Miele G 590 with a "universal" program was used as the dishwashing machine. The cleaning results of tablets E1 to E3 by comparison with an unfilled tablet V are shown in the following Table.

| | V | E1 | E2 | E3 |
|---|---|---|---|---|
| Milk | 7.5 | 9.7 | 9.7 | 10.0 |
| Egg yolk | 6.0 | 6.5 | 6.5 | 6.5 |
| Oat flakes | 7.0 | 8.2 | 9.0 | 8.5 |

The results show that tablets E1 to E3 according to the invention are far superior to the comparision tablet V.

What is claimed is:

1. A shaped body comprising builders, alkali sources, bleaching agents, enzymes, surfactants, and an ingredient (I), wherein a defined region of no greater than 40% by volume of the shaped body comprises more than 80% by weight of the total amount of the ingredient (I) that is contained in said shaped body, further wherein said ingredient (I) comprises at least one soil-release compound selected from the group consisting of cationic polymers, polyuronic acids, polyampholytes, and hydrophobicized polyampholytes.

2. The shaped body of claim 1, wherein the defined region is between 3 and 20% by volume of the shaped body and contains from 95% to 100% by weight of the total amount of ingredient (I) in said shaped body.

3. The shaped body of claim 1, wherein ingredient (I) further comprises at least one substance selected from the group consisting of chlorine bleaching agents, oxygen bleaching agents, bleach activators, silver protectors, enzymes, and components for controlling solubility.

4. The shaped body of claim 3, wherein the oxygen bleaching agents are selected from the group consisting of alkali metal perborates, alkali metal percarbonates, organic peracids, and hydrogen peroxide.

5. The shaped body of claim 1, wherein ingredient (I) further comprises a mixture of the soil-release compound and a fusible component for controlling solubility, the fusible component for controlling solubility selected from the group consisting of surfactants, paraffins, microwaxes, and high-molecular weight polyethylene glycols.

6. The shaped body of claim 1, wherein the shaped body further comprises 1% to 10% by weight of bleach activator, further wherein said bleach activator comprises at least one substance selected from the group consisting of polyacylated alkylenediamines, manganese complexes, manganese salts, cobalt complexes, and cobalt salts.

7. The shaped body of claim 6, wherein the bleach activator is at least one substance selected from the group consisting of N-nonanoyl succinimide (NOSI), n-nonanoyl oxybenzenesulfonate (n-NOBS), isononanoyloxybenzenesulfonate (iso-NOBS), and n-methyl morpholinium acetonitrile methyl sulfate (MMA).

8. The shaped body of claim 1, wherein the builders comprise at least one substance selected from the group consisting of tripolyphosphate, sodium carbonate, and sodium disilicate.

9. The shaped body of claim 1, wherein the surfactants comprise at least one substance selected from the group consisting of alkoxylated fatty alcohols, propoxylated fatty alcohols, alkyl polyglycosides, and alkyl polyglucamides.

10. The shaped body of claim 1, further comprising a silver protector selected from the group consisting of triazoles, benzotriazoles, bis-benzotriazoles, aminotriazoles, alkylaminotriazoles, transition metal salts, and transition metal complexes.

11. The shaped body of claim 10, wherein the transition metal salts are selected from the group consisting of manganese chlorides, manganese sulfates, and cobalt chlorides, further wherein the transition metal complexes are selected from the group consisting of cobalt (ammine) complexes, cobalt (acetate) complexes, and cobalt (carbonyl) complexes.

12. The shaped body of claim 1, further comprising a component for controlling solubility selected from the group consisting of paraffins, microwaxes, and high molecular weight polyethylene glycols.

13. The shaped body of claim l, further comprising a component for controlling solubility comprising at least one compound selected from the group consisting of organic acids, mixtures of one or More weak acids with carbonates or bicarbonates, celluloses, and cellulose derivatives.

14. A shaped body comprising at least two defined regions, said shaped body comprising an ingredient (I) and at least one substance selected from the group consisting of builders, bleaching agents, enzymes, and nonionic surfactants, wherein said ingredient (I) comprises at least one soil-release compound selected from the group consisting of cationic polymers, polyuronic acids, polyampholytes, and hydrophobicized polyampholytes and at least one substance selected from the group consisting of bleaching agents, bleach activators, silver protectors, enzymes, and components for controlling solubility, further wherein one of said defined regions, which has a volume of no greater than 40% of the total volume of the shaped body, contains more than 80% by weight of the total amount of the ingredient (I) in shaped body.

15. The shaped body of claim 14 comprising a bleaching agent and further comprising a perfume component, wherein the perfume component is not in the same region as the bleaching agent.

16. The shaped body of claim 14, wherein the ingredient (I) includes a silver protector and the region containing more than 80% of the total amount of ingredient (I) in the shaped body does not contain any bleaching agent.

17. The shaped body of claim 14, wherein the ingredient (I) comprises a component for controlling solubility and a bleach activator.

18. The shaped body of claim 14, wherein the ingredient (I) comprises a component for controlling solubility and the defined region which contains more than 80% by weight of the total amount of ingredient (I) in the shaped body also contains at least one enzyme, bleaching agent, or nonionic surfactant.

19. The shaped body of claim 14, wherein the ingredient (I) comprises a component for controlling solubility and the region containing more than 80% of the total amount of ingredient (I) in the shaped body also contains more than 70% by weight of at least one nonionic surfactant.

20. A shaped body comprising an outer surface and at least two defined regions with surfaces that are part of the outer surface of said shaped body, wherein said shaped body comprises builders, bleaching agents, enzymes, surfactants and an ingredient (I) which comprises a soil-release compound selected from the group consisting of cationic polymers, polyuronic acids, polyampholytes, and hydrophobicized polyampholytes, further wherein a first defined region of said shaped body which has a surface that forms a part of the outer surface of said shaped body comprises more than 80% by weight of the total amount of ingredient (I) that is contained in said shaped body, said first defined region having a volume which is no greater than 40% by volume of the total volume of the shaped body.

21. The shaped body of claim 20, wherein said ingredient (I) further comprises at least one substance selected from the group consisting of chlorine bleach agents, oxygen bleaching agents, beach activators, silver protectors, enzymes and components for controlling solubility.

* * * * *

UNITED STATES PATENT AND TRADEMARK OFFICE

CERTIFICATE OF CORRECTION

PATENT NO. : 6,410,500 B1
DATED : June 25, 2002
INVENTOR(S) : Haerer et al.

It is certified that error appears in the above-identified patent and that said Letters Patent is hereby corrected as shown below:

Title page,
Item [57], ABSTRACT,
Line 6, delete "(1)", and insert therefor -- (I) --.

Column 21,
Line 42, delete "More", and insert therefor -- more --.

Signed and Sealed this

Fifteenth Day of July, 2003

JAMES E. ROGAN
*Director of the United States Patent and Trademark Office*